US006301734B1

(12) United States Patent
Dunsbergen et al.

(10) Patent No.: US 6,301,734 B1
(45) Date of Patent: Oct. 16, 2001

(54) BULK DISPENSING AGITATOR AND METHOD FOR USING SAME

(75) Inventors: Kirk M. Dunsbergen, Newton; Jeffrey L. Sears, Grinnell; John E. Thomas, Des Moines; Daniel G. Petrak, Urbandale, all of IA (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 09/494,257

(22) Filed: Jan. 28, 2000

(51) Int. Cl.[7] ..... D06F 39/02
(52) U.S. Cl. ..... 8/158; 68/17 A
(58) Field of Search ..... 8/158; 68/17 A

(56) References Cited

U.S. PATENT DOCUMENTS 2,979,935 4/1961 Oles .
3,005,330 10/1961 Bochan .
3,010,304 11/1961 Altorfer .
3,027,741 4/1962 Bullock et al. .
3,085,417 4/1963 Oles .
3,724,242 * 4/1973 Davis ..... 68/17 A
5,359,744 * 11/1994 Kimball et al. ..... 68/17 A

* cited by examiner

*Primary Examiner*—Philip R. Coe
(74) *Attorney, Agent, or Firm*—Zarley, McKee, Thomte, Voorhees & Sease

(57) ABSTRACT

A bulk dispenser includes a dispensing chamber having an open upper end. A storage chamber is fitted within the dispensing chamber and includes a dispensing opening spaced above the bottom of the dispensing chamber. A valve is within the dispensing opening and is movable from a closed position preventing fluid from leaving the storage chamber to an open position permitting fluid to flow through the dispensing opening into the dispensing chamber. A spring biases the valve to its closed position.

18 Claims, 3 Drawing Sheets

BULK DISPENSING AGITATOR AND METHOD FOR USING SAME

BACKGROUND OF THE INVENTION

This invention relates to a bulk dispensing agitator and method for using same. Specifically it relates to a bulk dispensing agitator for use with a washing machine.

Many automatic washing machines incorporate a dispensing apparatus for dispensing conditioning agents such as fabric softening materials to the tub which contains the fabrics being washed. It is desirable to provide a storage chamber which dispenses the correct metered amount into a bulk dispenser for distribution into the tub of fabrics. It is also desirable to be able to store a sufficient amount in the storage chamber to accommodate several loads of fabrics.

Therefore a primary object of the present invention is the provision of an improved bulk dispenser for use in combination with a washing machine agitator.

A further object of the present invention is the provision of an improved method for using the bulk dispensing device of the present invention.

A further object of the present invention is the provision of a bulk dispensing device which stores a sufficient quantity of conditioner to accommodate several loads of fabrics in the washing machine.

A further object of the present invention is the provision of an improved bulk dispenser which permits the accurate metering of the amount of conditioner dispensed for each load of the washing machine.

A further object of the present invention is the provision of an improved bulk dispenser which permits adjustment of the amount metered for each load of fabric being washed.

A further object of the present invention is the provision of an improved bulk dispenser which can be easily mounted upon or removed from the upper end of an agitator within a conventional washing machine.

A further object of the present invention is the provision of an improved bulk dispenser which is simple in construction, economical to manufacture, and efficient in operation.

SUMMARY OF THE INVENTION

The foregoing objects may be achieved by a bulk dispenser adapted for mounting to an agitator of a washing machine. The bulk dispenser comprises a dispenser housing having side walls and a bottom wall forming a dispensing chamber. The side walls form an open upper end in the dispensing chamber.

A storage housing is provided with side walls, a bottom wall and a top wall forming a storage chamber. A dispensing opening is formed in the bottom wall.

A first attachment mechanism attaches the dispensing and storage housings together so that the storage housing is at least partially within the dispensing chamber of the dispenser housing. In that position the dispensing opening is positioned a predetermined distance above the bottom wall of the dispenser housing.

A valve is disposed within the dispensing opening of the dispenser housing and is movable from an open position providing fluid communication through the dispensing opening from the storage chamber to the dispensing chamber. The valve is also movable to a closed position preventing fluid communication through the dispensing opening from the storage chamber to the dispensing chamber.

A second attachment mechanism is connected to one of the dispenser and storage housings and is adapted to mount the dispenser and storage housings to the agitator.

According to one feature of the invention, the storage housing provides a substantially airtight closure to the storage chamber whereby when the valve is in its open position a fluid within the storage chamber will pass by gravity through the dispensing opening into the dispensing chamber until the fluid level within the dispensing chamber reaches the dispensing opening. At that point the fluid level stops and fluid will cease passing from the storage chamber to the dispensing chamber.

According to another feature of the invention, the bulk dispenser includes a plurality of centrifugal openings in its side walls for permitting the fluid to exit the dispensing chamber during rotation of the dispensing chamber about a vertical axis.

According to another feature of the invention the first attachment mechanism adjustably attaches the dispenser and the storage housings together for vertical adjustment of the dispensing opening relative to the bottom wall of the dispenser housing.

According to a further feature of the invention the first attachment mechanism comprises a slot formed in one of the dispenser and storage housings and a pin formed on the other of the dispenser and storage housings. The pin extends within the slot.

According to a further feature of the present invention the second attachment mechanism comprises a skirt having downwardly presented edges sized and shaped to register with and attach to the upper end of the agitator.

According to a further feature of the present invention the bulk dispenser includes a spring biasing the valve to its closed position.

The method of the present invention comprises filling an airtight storage compartment with fluid. Next, the airtight storage chamber, which includes a dispensing opening therein, is mounted at least partially within a dispensing chamber having a bottom wall so that the dispensing opening of the storage chamber is spaced above the bottom wall of the dispensing chamber. A valve is placed within the dispensing opening in a closed position preventing fluid communication through the dispensing opening. The valve is moved from its closed position to an open position permitting fluid to pass from the storage chamber through the dispensing opening to the dispensing chamber whereby the level of the fluid within the dispensing chamber will rise until reaching the dispersing opening and then will stop. The valve is then moved to its closed position after the fluid level within the dispensing chamber reaches the dispensing opening. The final step of the method comprises rotating the agitator about a vertical axis to permit the fluid to exit by centrifugal force from the dispensing chamber through outflow openings in the dispenser chamber.

DETAILED DESCRIPTION OF THE PREFERRED EMBODIMENT

Figure 1:
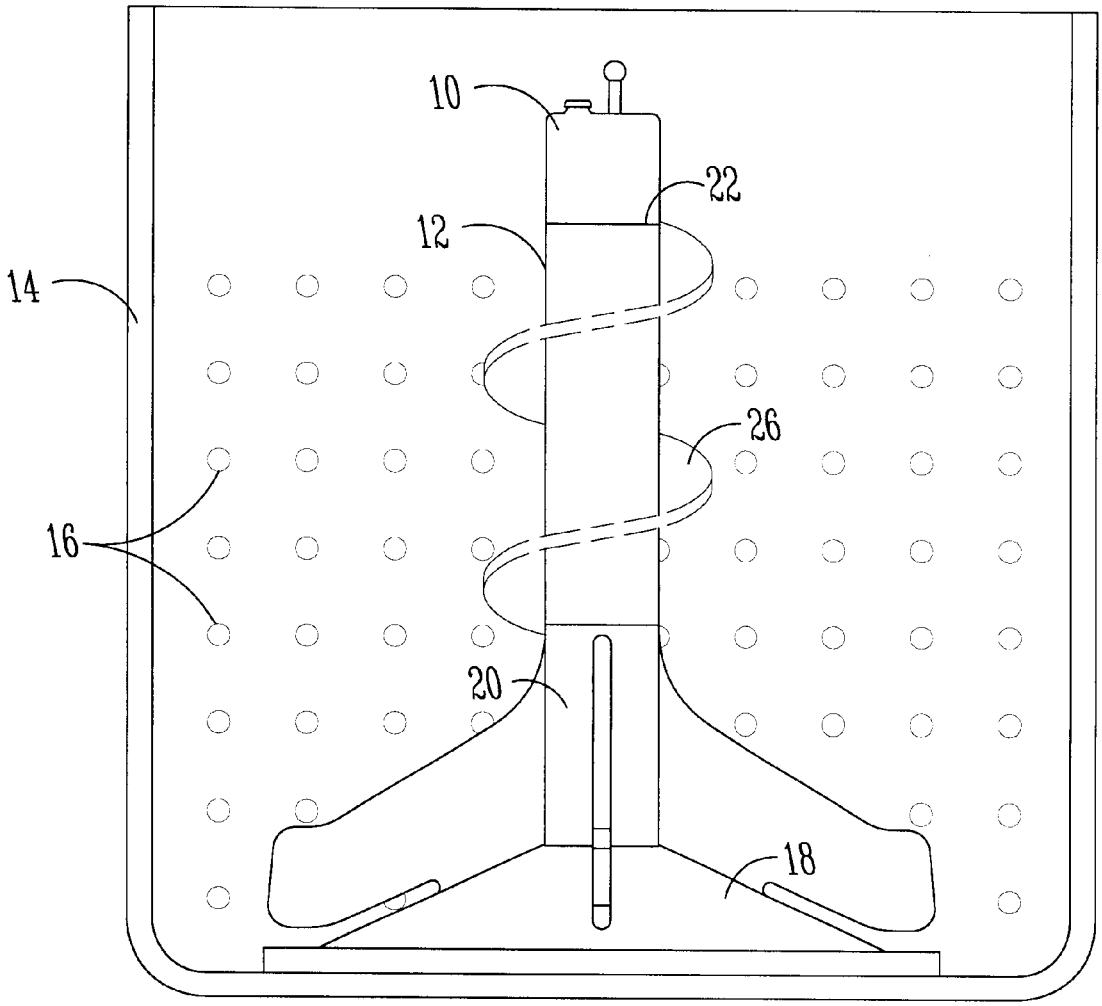
FIG. 1 is a sectional view of a typical washing machine perforated tub having an agitator therein and having the present invention mounted on the upper end of the agitator.

The numeral 10 generally designates the bulk dispenser of the present invention. Bulk dispenser 10 is mounted on the upper end of an agitator 12 which is mounted within a perforated washing machine tub 14. Tub 14 includes a plurality of perforations 16 within its walls.

Figure 2:
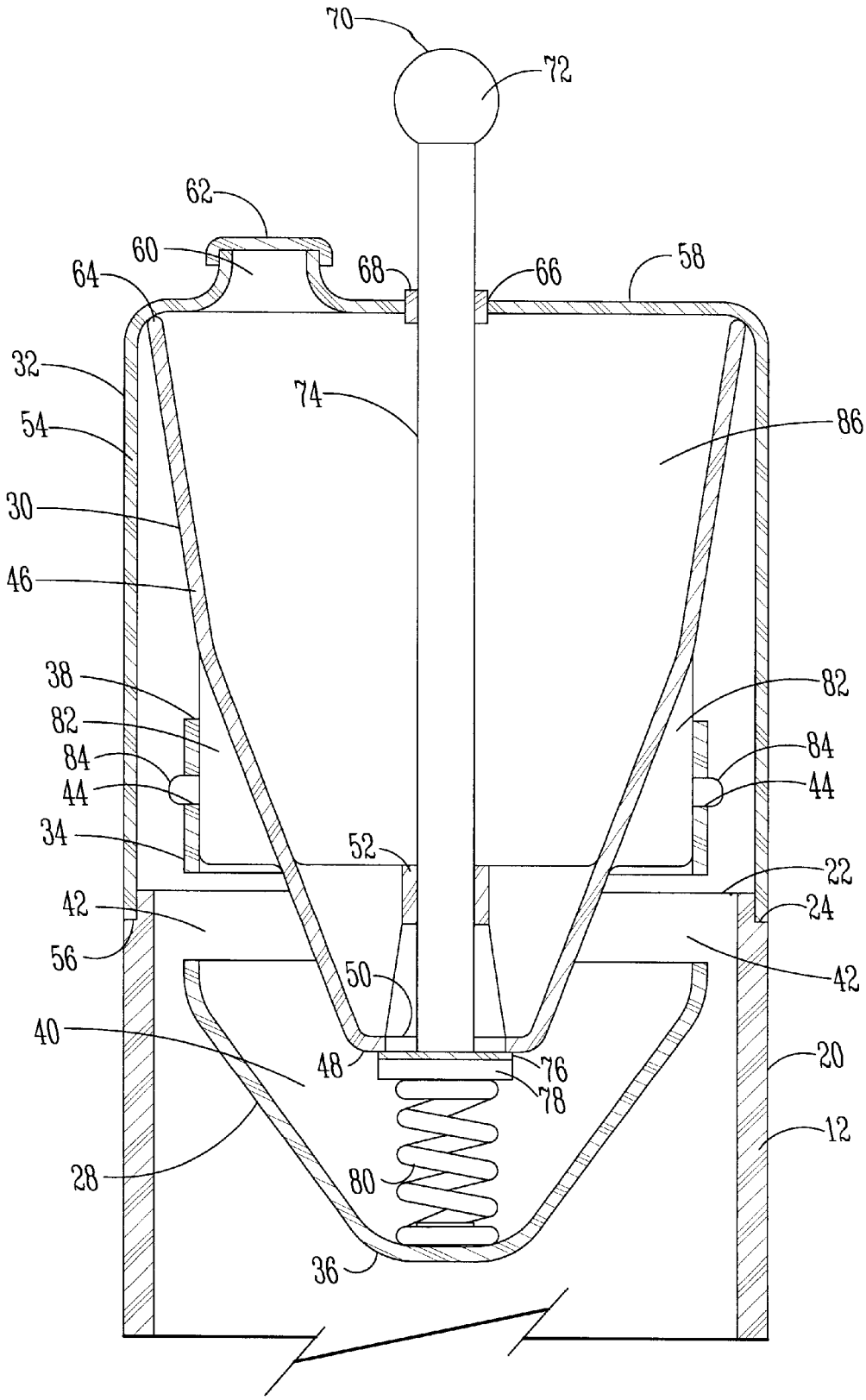
FIG. 2 is a detailed sectional view of the bulk dispenser of the present invention.
Figure 3:
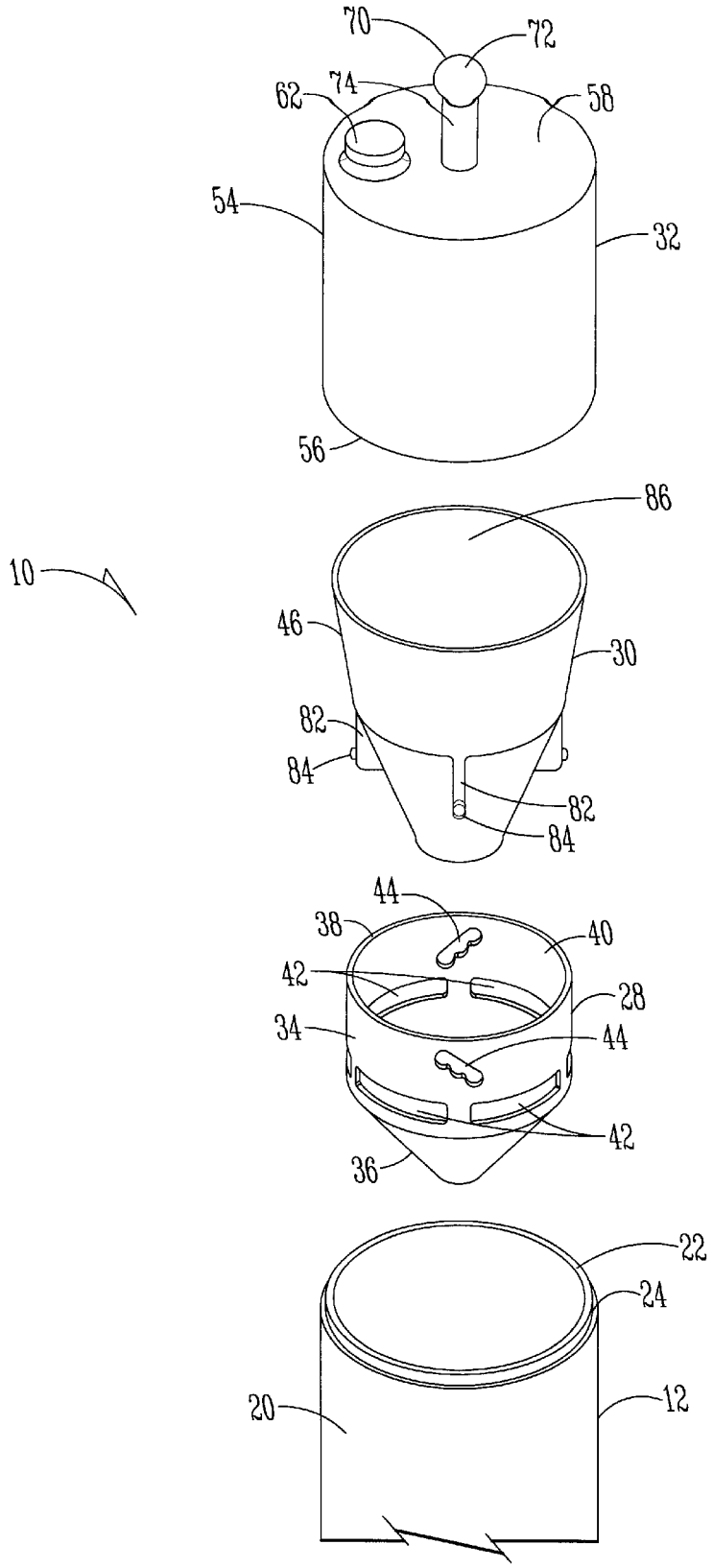
FIG. 3 is an exploded perspective view of the bulk dispenser of the present invention and the upper end of the agitator.

The agitator 12 includes a base 18 having a barrel 20 extending upwardly therefrom and terminating in an upper end 22. As can be seen in FIGS. 2 and 3 the upper end 22 of the barrel 20 is provided with a press fit channel 24 adapted to receive the dispenser 10 of the present invention. Extending around the barrel 20 is a helical flighting 26.

The dispenser 10 of the present invention is comprised of a dispenser housing 28, and a storage housing 30 which includes a storage housing skirt 32 attached thereover.

The dispensing housing 28 includes a dispensing housing side wall 34 having a cone shaped bottom wall 36 and an annular open top edge 38, which together form a dispensing chamber 40. The side walls 34 are provided with release openings 42 for permitting any conditioning fluid within the dispenser chamber 40 to be released radially outwardly by centrifugal force in response to rotation of the dispenser housing 28. The side walls 34 of the dispenser housing 28 are also provided with inclined cam slots 44.

The storage housing 30 includes storage housing side walls 46 and a bottom wall 48. A dispensing opening 50 is provided in bottom wall 48. An annular plunger guide 52 is mounted to the bottom wall 48 and extends upwardly therefrom as shown in FIG. 2.

Skirt 32 includes skirt side walls 54 which terminate at lower annular edges 56. As can be seen in FIG. 2 the annular edges 56 are adapted to press fit around the press fit channel 24 so as to mount the skirt 32 over the upper end of barrel 20.

Skirt 32 also includes a top wall 58 having a fill opening 60 therein which is covered by a fill cap 62. The skirt 32 is permanently attached to the upper annular edges of the storage housing side walls 46 by means of welds located at 64.

The top wall 58 of skirt 32 also is provided with a plunger opening 66 which is surrounded with an annular plunger seal 68.

A plunger 70 includes a plunger handle 72 and a shank 74 which is fitted within the plunger seal 68 and the annular plunge guide 52 as shown in FIG. 2. The lower end of the shank 74 extends through the dispensing opening 50 and includes an elastomeric seal 76 and a backup washer 78 mounted to its lower end. The seal 76 is sized to fit in covering relation over the dispensing opening 50 and provides a fluid tight seal thereover. The plunger seal 78 and the backup washer 78, together with the plunger 70 provide a valve which is movable from a closed position shown in FIG. 2 preventing fluid from exiting the storage chamber 86 to an open position spaced downwardly therefrom which permits fluid to exit from the storage chamber 86.

A return spring 80 is compressed between the backup washer 78 and the bottom wall 36 of the dispenser housing 28. This biases the valve or plunger 70 to its closed position. The storage housing 30 is fitted partially within the dispensing chamber 40 with the bottom wall 48 and the dispensing opening 50 of the storage chamber spaced a predetermined distance above the bottom wall 36 of the dispensing chamber. The storage housing 30 includes four radially outwardly extending pin ribs 82 having pins 84 on their outer edges. The pins 84 fit within the slots 44 of the dispenser housing 28, thereby attaching the storage chamber housing 30 to the dispensing chamber housing 28 in the position shown in FIG. 2.

The distance of bottom wall 48 of the storage chamber above the bottom wall 36 of the dispensing chamber may be adjusted by rotating the storage chamber 30 relative to the dispensing chamber 28. This causes the pins 84 to raise or lower within the angled cam slots 44 thereby raising or lowering the bottom wall 48 of the storage housing 30 relative to the bottom wall 36 of the dispenser housing 28.

The storage chamber 86 is substantially airtight, and this feature permits the storage chamber 86 to meter the amount of fluid dispensed into the dispensing chamber 40. In operation the storage chamber 86 is filled with fluid through fill opening 60. Next the plunger 70 is depressed and moved to its open position, and fluid begins flowing through dispensing opening 50 into the dispensing chamber 40. When the fluid level within dispensing chamber 40 reaches the dispensing opening 50, the flow of fluid ceases. This is a result of the airtight nature of chamber 86 which prevents the escape of fluid through dispensing opening 50 after the dispensing opening 50 is immersed in the fluid within dispensing chamber 40. At this point the plunger 70 is permitted to move back to its closed position.

During the rotation of the agitator during the spin portion of the washing cycle of the washing machine, the fluid within the dispensing chamber 40 is flung radially outwardly by means of centrifugal force through the openings 42 and is thus dispensed into the washing fluid within the tub 14.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing form the spirit or scope of the invention as further defined in the following claims.

What is claimed is:

1. A bulk dispenser adapted for mounting to an agitator of a washing machine, said agitator having an upper end, said bulk dispenser comprising:

a dispenser housing having side walls and a bottom wall forming a dispensing chamber, said side walls forming an open upper end;

a storage housing having side walls, a bottom wall, and a top wall forming a storage chamber, a dispensing opening being formed in one of said housing walls;

a first attachment mechanism attaching said dispenser and said storage housings together so that said storage housing is at least partially within said dispensing chamber with said dispensing opening positioned a predetermined distance above said bottom wall of said dispenser housing;

a dispenser valve within said dispensing opening of said dispenser housing and being movable from an open position providing fluid communication through said dispensing opening from said storage chamber to said dispensing chamber to a closed position preventing fluid communication through said dispensing opening from said storage chamber to said dispensing chamber; and second attachment mechanism connected to one of said dispenser and storage housings and being adapted to mount said dispenser and storage housings to said agitator.

2. A bulk dispenser according to claim 1 wherein said storage housing provides a substantially air tight closure to said storage chamber whereby when said valve is in said oven position a fluid within said storage chamber will pass by gravity through said dispensing opening into said dispensing chamber until the fluid level within said dispensing chamber reaches said dispensing opening of said storage housing.

3. A bulk dispenser according to claim 1 wherein said side walls of said dispenser housing include a plurality of openings therein for permitting said fluid to exit said dispensing chamber during rotation of said dispensing chamber about a vertical axis.

4. A bulk dispenser according to claim 1 wherein said first attachment mechanism adjustably attaches said dispenser and storage housings together for vertical adjustment of said dispensing opening relative to said bottom wall of said dispenser housing.

5. A bulk dispenser according to claim 4 wherein said first attachment mechanism comprises a slot formed in one of said dispenser and storage housings and a pin formed on the other of said dispenser and storage housings, said pin extending within said slot.

6. A bulk dispenser according to claim 1 wherein said second attachment mechanism comprises a skirt having downwardly presented edges sized and shaped to register with and attach to said upper end of said agitator.

7. A bulk dispenser according to claim 1 and further comprising a spring biasing said valve to said closed position.

8. In combination:

an agitator for a washing machine, said agitator having an upper end;

a dispenser housing and a storage housing connected to one another and to said upper end of said agitator;

said dispenser housing having side walls and a bottom wall forming a dispensing chamber, said side walls having upper edges forming an open upper end of said dispensing chamber;

said storage housing having side walls, a bottom wall, and a top wall forming a storage chamber, one of said side walls and said bottom wall having a dispensing opening therein;

said storage housing being at least partially within said dispensing chamber of said dispenser housing with said dispensing opening of said storage housing being positioned a predetermined distance above said bottom wall of said dispenser housing;

a valve within said dispensing opening of said dispenser housing movable from an open position wherein fluid from said storage chamber is free to move through said dispensing opening to said dispensing chamber to a closed position wherein fluid from said storage chamber is prevented from moving through said dispensing opening to said dispensing chamber.

9. A bulk dispenser according to claim 8 wherein said storage housing provides a substantially air tight closure to said storage chamber whereby when said valve is in said open position a fluid within said storage chamber will pass by gravity through said dispensing opening into said dispensing chamber until the fluid level within said dispensing chamber reaches said dispensing opening of said storage housing.

10. A bulk dispenser according to claim 8 wherein said side walls of said dispenser housing include a plurality of openings therein for permitting said fluid to exit said dispensing chamber during rotation of said dispensing chamber about a vertical axis.

11. A bulk dispenser according to claim 8 wherein a first attachment mechanism adjustably attaches said dispenser and storage housings together for vertical adjustment of said dispensing opening relative to said bottom wall of said dispenser housing.

12. A bulk dispenser according to claim 11 wherein said first attachment mechanism comprises a slot formed in one of said dispenser and storage housings and a pin formed on the other of said dispenser and storage housings, said pin extending within said slot.

13. A bulk dispenser according to claim 8 wherein a second attachment mechanism is connected to one of said storage and said dispenser housings and comprises a skirt having downwardly presented edges attached to said upper end of said agitator.

14. A bulk dispenser according to claim 8 and further comprising a spring biasing said valve to said closed position.

15. A bulk dispenser adapted to be attached to an agitator of a washing machine, said agitator having an upper end and being rotated about a vertical axis, said bulk dispenser comprising:

a storage housing forming a substantially air tight storage chamber therein;

a dispenser housing forming a dispensing chamber therein;

a first attachment mechanism connecting said storage chamber to said dispensing chamber;

said storage housing having a dispenser opening therein providing fluid communication from said storage chamber to said dispensing chamber, said dispenser opening being located within said dispensing chamber;

a valve within said dispenser opening movable from a closed position preventing fluid communication through said dispenser opening from said storage chamber to said dispensing chamber to an open position permitting fluid communication through said dispensing opening from said storage chamber to said dispensing chamber; and a second attachment mechanism adapted to connect said storage housing and said dispenser housing to said agitator.

16. A bulk dispenser according to claim 15 wherein said dispenser housing includes a bottom wall and said dispenser opening of said storage housing is located in spaced relation above said bottom wall of said dispenser housing whereby fluid within said storage housing will flow through said dispenser opening when said valve is in said open position until the level of fluid within said dispenser housing reaches the height of said dispenser opening.

17. A bulk dispenser according to claim 16 wherein said first attachment mechanism permits manual adjustment of the distance that said dispenser opening is positioned above said bottom wall of said dispenser housing, thereby permitting manual adjustment of the volume of fluid which will be in said dispenser chamber at the time said fluid within said dispenser opening reaches the height of said dispenser opening.

18. A method for dispensing fluid into a washing machine comprising:

filling an air tight storage chamber with said fluid;

mounting an air tight storage chamber having a dispensing opening therein at least partially within a dispensing chamber having a bottom wall so that said dispensing opening is spaced above said bottom wall of said storage chamber;

placing a valve within said dispensing opening in a closed position preventing fluid communication through said dispensing opening;

moving said valve from said closed position to an open position permitting said fluid to pass from said storage chamber through said dispensing opening to said dispensing chamber, whereby the level of said fluid within said dispensing chamber will rise until reaching said dispensing opening and then will stop;

moving said valve to said closed position after said fluid level within said dispensing chamber reaches said dispensing opening; and rotating said agitator about a vertical axis to permit said fluid to exit by centrifugal force from said dispensing chamber through outflows openings in said dispenser chamber.

* * * * *